US009953777B2

(12) United States Patent
Zimmel

(10) Patent No.: US 9,953,777 B2
(45) Date of Patent: Apr. 24, 2018

(54) SWITCHING DEVICE

(71) Applicant: EATON INDUSTRIES (AUSTRIA) GMBH, Schrems (AT)

(72) Inventor: Raffael Zimmel, Tulln an der Donau (AT)

(73) Assignee: EATON INDUSTRIES (AUSTRIA) GMBH, Schrems (AT)

( * ) Notice: Subject to any disclaimer, the term of this patent is extended or adjusted under 35 U.S.C. 154(b) by 0 days.

(21) Appl. No.: 15/329,585

(22) PCT Filed: Jul. 16, 2015

(86) PCT No.: PCT/EP2015/066274
§ 371 (c)(1),
(2) Date: Jan. 27, 2017

(87) PCT Pub. No.: WO2016/016009
PCT Pub. Date: Feb. 4, 2016

(65) Prior Publication Data

US 2017/0229260 A1 Aug. 10, 2017

(30) Foreign Application Priority Data

Jul. 29, 2014 (DE) ..... 10 2014 110 757

(51) Int. Cl.
*H01H 3/46* (2006.01)
*H01H 21/22* (2006.01)
*H01H 3/38* (2006.01)

(52) U.S. Cl.
CPC ..... *H01H 21/22* (2013.01); *H01H 3/38* (2013.01); *H01H 3/46* (2013.01); *H01H 2235/01* (2013.01)

(58) Field of Classification Search
CPC .. H01H 71/504; H01H 71/505; H01H 71/525; H01H 1/52; H01H 33/127
(Continued)

(56) References Cited

U.S. PATENT DOCUMENTS 4,618,745 A 10/1986 Thompson, III
5,931,289 A * 8/1999 Chou ..... H01H 71/504 200/288
(Continued)

FOREIGN PATENT DOCUMENTS

CN 102426999 A 4/2012
DE 2242128 A1 3/1974
(Continued)

*Primary Examiner* — Ahmed Saeed
(74) *Attorney, Agent, or Firm* — Leydig, Voit & Mayer, Ltd.

(57) ABSTRACT

A switching device has a housing-mounted contact and a movable contact. The movable contact is provided for making contact with the housing-mounted contact. The switching device has a switch lock with a latch and a latch support, wherein the latch support has a latching location for latching the latch to the latch support, wherein the switching device furthermore has a hand switching lever. A connecting rod is mounted movably on the latch support, the connecting rod bearing against a projection of the hand switching lever when the hand switching lever is arranged in the position in which the contacts are in contact. An actuation of the hand switching lever—for separating the movable contact from the housing-mounted contact—moves the connecting rod and thereby releases the latching of the latching support to the latch.

12 Claims, 3 Drawing Sheets

(58) Field of Classification Search
USPC .... 200/321, 325, 50.18, 318, 320, 401, 323; 335/167, 16
See application file for complete search history.

(56) References Cited

U.S. PATENT DOCUMENTS

| | | | | |
|---|---|---|---|---|
| 6,867,672 | B2 * | 3/2005 | Vierling | H01H 71/526 200/325 |
| 6,924,446 | B1 * | 8/2005 | Marks | H01H 71/505 200/318 |
| 2013/0126319 | A1 * | 5/2013 | Godesa | H01H 21/50 200/321 |
| 2013/0168213 | A1 * | 7/2013 | Kim | H01H 3/04 200/322 |

FOREIGN PATENT DOCUMENTS

| | | | |
|---|---|---|---|
| DE | 2138380 | B2 | 10/1975 |
| DE | 2943695 | A1 | 5/1981 |
| DE | 3028377 | A1 | 2/1982 |
| EP | 680661 | B1 | 3/1997 |
| GB | 1398857 | A | 6/1975 |

* cited by examiner

SWITCHING DEVICE

CROSS-REFERENCE TO RELATED APPLICATIONS

This application is a U.S. national stage application under 35 U.S.C. § 371 of International Application No. PCT/EP2015/066274, filed on Jul. 16, 2015, and claims benefit to German Patent Application No. DE 10 2014 110 757.8, filed on Jul. 29, 2014. The International Application was published in German on Feb. 4, 2016, as WO 2016/016009 A1 under PCT Article 21(2).

FIELD

The invention concerns a switching device having a housing-mounted contact and a movable contact.

BACKGROUND

In low-voltage switching devices with a manual control button, i.e., having a manually operated element for closing the switched contacts and establishing a conductive current path via the switching device, it is usual that there is a movable switched contact, which is connected mechanically to the manual control button, and which, as the manual control button is actuated, is continually moved closer to a housing-mounted switched contact until both the switched contacts are connected mechanically. The opening of the contact, i.e., the switching-off of the switching device, takes place in accordance with the movement of the corresponding manual control button in the corresponding direction, which results in a continuous disconnection of the contacts. There exists a possibility that a user can maintain the manual control button in an arbitrary intermediate position, keeping the contacts in a correspondingly intermediate position.

If the switching device in question is under electric potential, at a certain distance between the closing switched contacts, an electric arc can be produced. With sufficiently low voltage and with users of electricity that require only small amounts of current to be conducted via the switching device, no problem is generally created as a result.

At higher voltages and currents, e.g., 600 V and 100 A, such an electric arc, which occurs because of an excessively slow manual separation of the contacts, can lead to significant damage to the affected switching device. If there is an accordingly high current flowing via the switching device in question when the disconnection takes place, the slow manual opening of the contacts can lead to an electric arc that can lead not only to a complete loss of the switching device in question, but also to a fire.

There are known devices with a so-called jump switch-off function. With it, the switched contacts are separated rapidly when disconnecting manually, independently of the manner and speed with which the operator actuates the manual control button. However, such jump switch-off functions are common primarily in the field of very large circuit breakers, such as those used in electric substations. Such switching devices have separately charged spring-loaded accumulators, which are used when opening or closing the contacts, wherein the use of this technology in compact switching devices is hardly possible, since an integration of the necessary components is not possible in the correspondingly compact housings.

SUMMARY

An aspect of the invention provides a switching device, comprising: a movable contact, positioned on a contact arm, movably attached to the switching device, the movable contact being configured to contact a housing-mounted contact and configured to establish a conductive current path through the switching device; a switch lock, connected with the contact arm, the switch lock including a latch and a latch support, the latch support including a latching location configured to latch the latch to the latch support; a hand switching lever, configured to contact the movable contact with the housing-mounted contact, the hand switching lever being connected with the contact arm; a connecting rod, mounted movably on the latch support, the connecting rod bearing against a projection of the hand switching lever when the hand switching lever is in a position in which the contacts are in contact, wherein an actuation of the hand switching lever, for separating the movable contact from the housing-mounted contact, moves the connecting rod and, thus, releases the latching of the latch support to the latch.

BRIEF DESCRIPTION OF THE DRAWING

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

An aspect of the invention provides a switching device in which the drawbacks specified, e.g., in the Background, can be avoided and which makes a safe switching-off of the switching device possible, has a compact design, and is easy to manufacture.

As a result, a safe switching-off of the switching device, and thus a safe contact separation, may be accomplished, regardless of the speed with which the user actuates the hand switching lever. The switching device described can thus have a compact design, with a small number of necessary parts.

Figure 1:
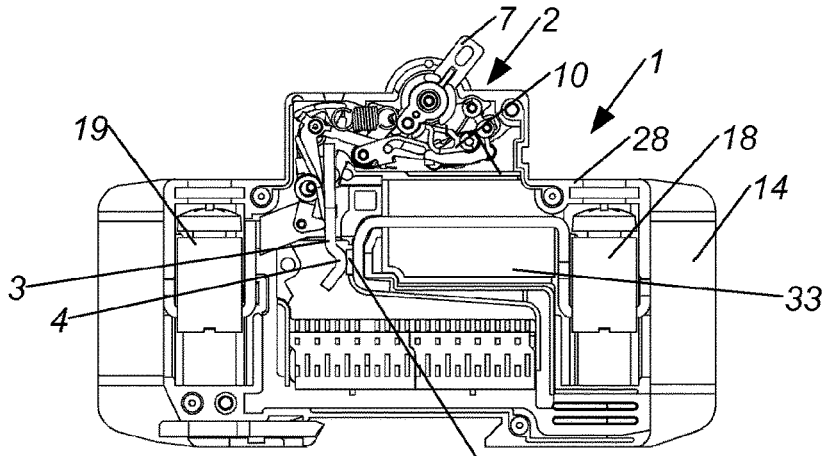
FIG. 1 a perspective view of the proposed switching device in the switched-on state without the upper housing shell.
Figure 2:
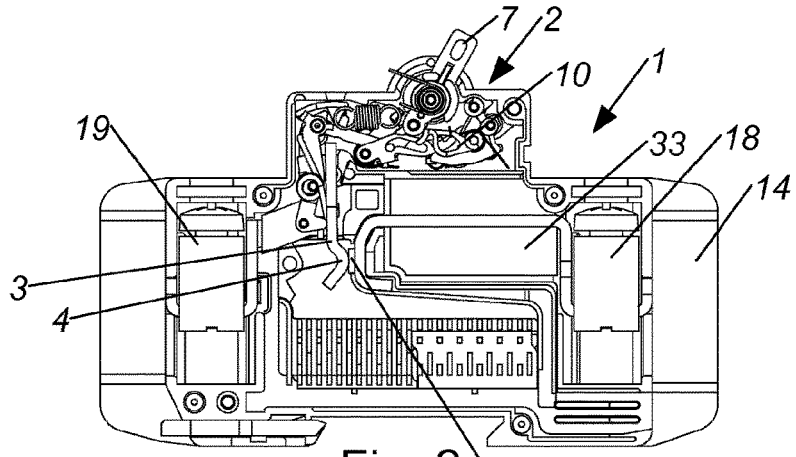
FIG. 2 the switching device as shown in FIG. 1, wherein the hand switching lever is moved from the switched-on position, and the switching device still remains in the switched-on state.
Figure 3:
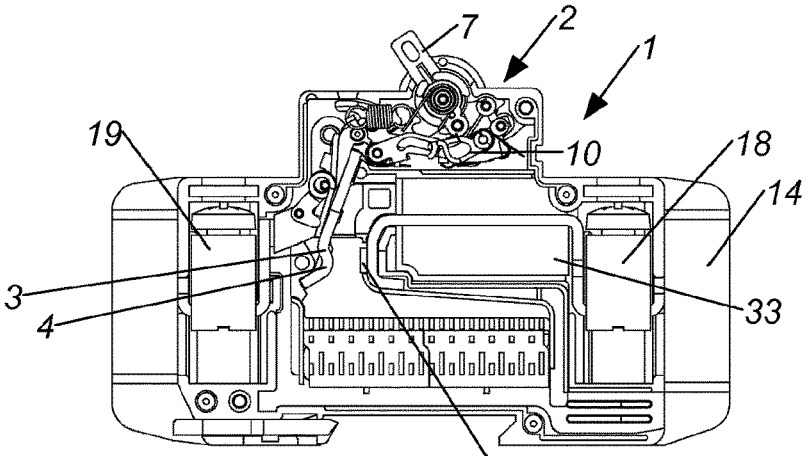
FIG. 3 the switching device as shown in FIG. 1, in the switched-off state.

FIGS. 1 through 3 show a particularly preferable execution of a switching device 1—in particular, a safety switching device—with a housing-mounted contact 6 and a movable contact 4, wherein the movable contact 4 is positioned on a contact arm 3 movably arranged on the switching device 1, wherein the movable contact 4 is provided for making contact with the housing-mounted contact 6 and establishing a conductive current path through the switching device 1, wherein the switching device 1 has a switch lock 2 connected with the contact arm 3, wherein the switch lock 2 has a latch 20 and a latch support 22, wherein the latch support 22 has a latching location 24 for latching the latch 20 to the latch support 22, wherein the switching device 1 also has a hand switching lever 7, which hand switching lever 7, for contacting the movable contact 4 with the housing-mounted contact 6, is connected with the contact arm 3, wherein a connecting rod 10 is, further, mounted movably on the latch support 22, wherein the connecting rod 10 bears against a projection 11 of the hand switching lever 7 when the hand switching lever 7 is set in the position in which the contacts 4, 6 are in contact, and wherein the actuation of the hand switching lever 7—for separating the movable contact (4) from the housing-mounted contact 6—moves the connecting rod 10 and thereby releases the latching of the latch support 22 to the latch 20.

FIGS. 4 through 9 show details of the switching device 1 described.

As a result, a safe switching-off of the switching device 1, and thus a safe contact separation, may be accomplished, regardless of the speed with which the user actuates the hand switching lever 7. The switching device 1 described can thus have a compact design, with a small number of required parts.

The present invention concerns an electrical switching device 1, wherein it is preferable that the switching device 1 be designed as a safety switching device or a so-called automatic switch. It is preferable that the switching device 1 be designed as a safety circuit breaker or a circuit switch. It is preferable that the switching device 1 be designed as a compact, low-voltage safety switching device. In accordance with the preferred design, the switching device 1 includes at least one trigger 33. FIGS. 1 through 3 show an electromagnetic trigger 33, such as a short-circuit trigger. Additionally, a typically-designed thermal trigger, such as a bi-metallic trigger for overcurrent release, can be provided. Furthermore, it can be provided that the triggers 33 in question be combined.

Figure 4:
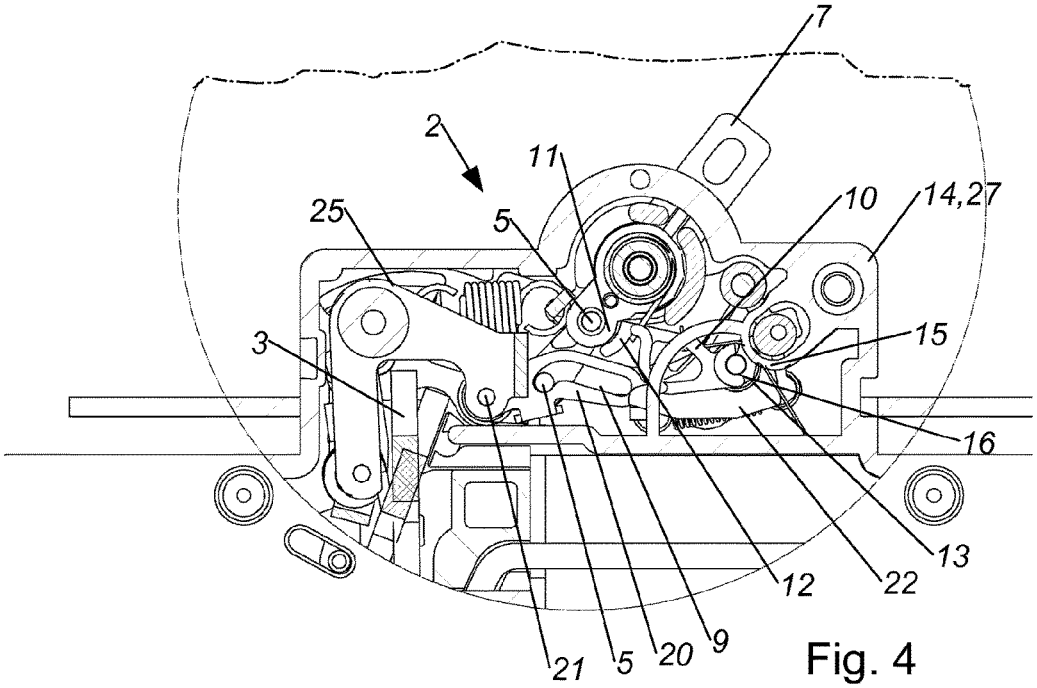
FIG. 4 a detailed view of the switching device as shown in FIG. 1, with the upper housing shell partially shown in sectional view.
Figure 5:
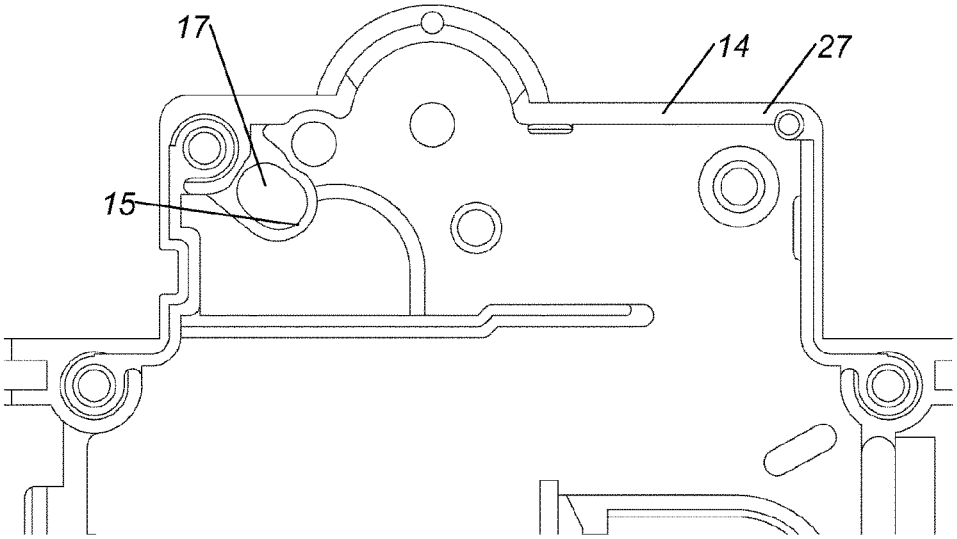
FIG. 5 a sectional view of the upper housing shell of the switching device as shown in FIG. 1.

The switching device 1 has a housing 14 made out of an insulating material, preferably designed as a two-piece part, with two housing halves or shells. FIGS. 1 through 3 show the lower housing half 28. FIGS. 4 and 5 show the upper housing half 27.

The switching device 1 has at least one movable contact 4 and at least one housing-mounted contact 6. According to the illustrated preferred execution, the switching device 1 has a so-called double break, thus being provided with two movable contacts 4 and two housing-mounted contacts 6, which are assigned, however, to a single switching path.

If the at least one movable contact 4 has an electrically conductive connection with the at least one housing-mounted contact 6, an electrically conductive current path through the switching device 1 exists. The switching device 1 has two connecting terminals 18, 19. If there is no such electrically conductive connection via the switching device 1, it is regarded as switched-off, i.e., in a switched-off state. If there is such an electrically conductive connection, the switching device is regarded as switched-on, i.e., in a switched-on state. As is customary, the transitions between the two states are accordingly called the switching-on and the switching-off of the switching device 1. Synonymously, the label closed contacts 4, 6 can also be used to refer to the switched-on state, while open contacts 4, 6 can be used for the switched-off state.

The at least one movable contact 4 is arranged on a movable contact arm 3. According to the preferred execution configuration, the contact arm 3 has two movable contacts 4, which are located on the corresponding parallel forked extensions 23 of the contact arm 3, which in this execution can also be referred to as contact or switching bridges.

The switching device 1 has a so-called switch lock 2. The switch lock 2 is a mechanical component that controls the movements of the contact arm 3. In the preferable and presented design, besides the contact arm 3, the switch lock 2 also has a latch 20 and a latch support 22. FIGS. 4, 6, 7, 8, and 9 show the corresponding assemblies in different views, in separation from the other components of the switching device 1.

In the representative switch lock 2, the switching lever 7 is connected to the contact arm 3 via a first brace 5 and a bracket 8 affixed to the first brace 5. The first brace 5 is guided via a guiding slot 9 of the pivotably mounted latch 20.

The switching device 1 has a jump switch-off mechanism for manually-actuated rapid separation of the contacts 4, 6. Up to this jump switch-off mechanism, the present switch lock 2 matches (according to the preferred execution configuration) the switch lock 2 as presented in EP 680 661 B1.

The switch lock 2 has two essentially parallel base plates 25, between which the individual components are mounted. The latch support 22 is provided with a latching location 24 to which the latch 20 can catch so as to form a so-called latching. The latch support 22 is mounted between the two base plates 25 in a way that allows it to swivel. The latch 20 should preferably be a metal part, and is fastened between the base plates 25, also in a way that allows it to swivel. On the latch 20, which is provided with two lateral arms 26, a guiding slot 9 is positioned, by means of which a part of the first (preferably, U-shaped) brace 5 engages. Between the two lateral arms 26 of the latch 20, and on the part of the first brace 5, the bracket 8 is located, which is connected with the movable contact arm 3.

A connecting rod 10 is mounted on the latch support 22, allowing for movement. If the switching lever 7 is set in the position in which the contacts 4, 6 are in contact, the connecting rod 10 is positioned on a projection 11 of the switching lever 7. It should be noted at this point that the switching lever 7 can also take this position without the contacts 4, 6 actually being in contact, e.g., if the so-called trip-free mechanism of a sealed hand switching lever 7 leads to a release of the switching device 1 and separation of the contacts 4, 6.

It is preferable that the first brace 5 be mounted on or in the projection 11 of the switching lever 7, as shown. The hand switching lever 7 is rotated in order to switch the switching device 1 on. As a result, the position of the projection 11 inside the switching device 1 also changes. It is preferable that the switching lever 7 be designed to have multiple components, and the projection 11 is a part of an internal part of the switching lever 7.

As soon as the switching lever 7 is set to the switched-on position, the connecting rod 10 bears against the projection 11. The connecting rod 10 has a length that is appropriate for this purpose. The connecting rod 10 is mounted on the latch support 22 and can rotate in this position. Furthermore, the connecting rod 10 is attached to the latch support 22, preferably under spring tension, wherein the so-called connecting rod spring 13, which preferably is mounted on the latch support 22 itself, impinges upon the connecting rod 10 in the direction toward the switching lever 7.

The connecting rod 10 is preferably designed as a plastic component and has, according to the present preferable execution configuration, two arms, which run from the support point to the engagement area 12, thus spanning over a gap.

In the switched-on state of the switching device 1, the connecting rod 10 bears against the projection 11 of the switching lever 7, between the switching lever 7 and the latch support 22. It is provided for the connecting rod 10 to be moved from this position by actuating or turning the switching lever 7. The connecting rod 10 then moves the latch support 22, shifting it in a way that releases the latching between the latch support 22 and the latch 20, resulting in a "release" of the switch lock 2, and therefore, the separation of the contacts 4, 6, specifically via the switch lock 2. Using the switching lever 7 to maintain the movable contact 4 in a position close to the housing-mounted contact 6 is, thus, no longer possible. It should be mentioned for the sake of completeness that, from the described switched-on position, an actuation or rotation of the switching lever 7 is possible in one direction only—that which leads to the separation of the contacts 4, 6.

Figure 6:
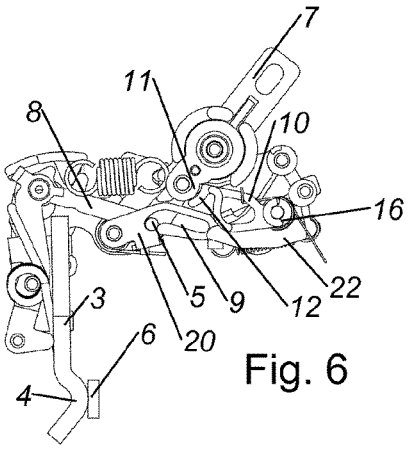
FIG. 6 a perspective view of the arrangement of the switch lock, contact arm, and switching lever of the switching device as shown in FIG. 1, in the switched-on state.
Figure 7:
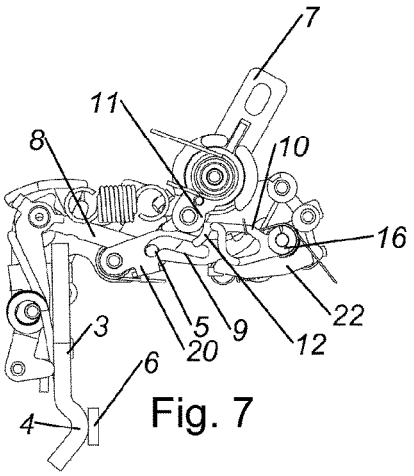
FIG. 7 the arrangement as shown in FIG. 6, wherein the hand switching lever is moved from the switched-on position, and the contacts are still connected.
Figure 9:
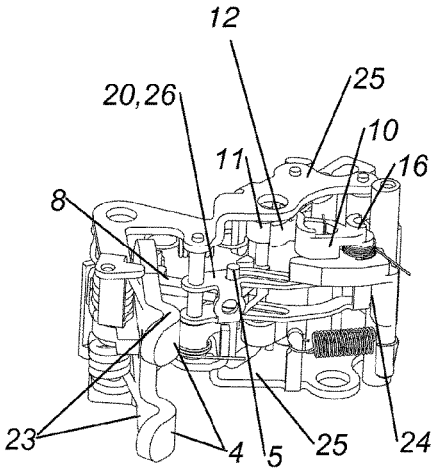
FIG. 9 the arrangement as shown in FIG. 6, in the axonometric view.
Figure 8:
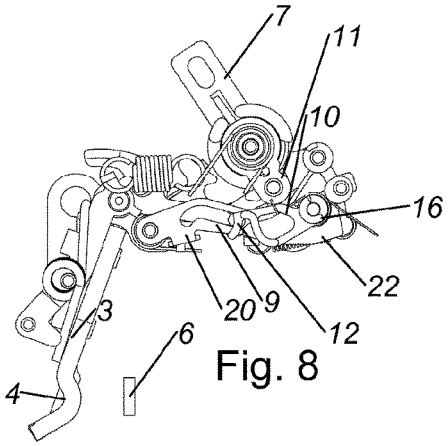
FIG. 8 the arrangement as shown in FIG. 6, in the switched-off state.

The length of the connecting rod 10 must be such that it allows for a release of the latching before the contacts 4, 6 are separated. FIGS. 1, 4, and 6 all show the switched-on state. FIGS. 2 and 7 likewise show a state with the contacts 4, 6 closed, wherein the switching lever 7 is clearly already moved in a direction that would result in an opening of the contacts. It is also shown how the connecting rod 10 has already been shifted, and with it, a movement of the latch support 22 initiated, leading to a release of the latching. This results in the state shown in FIGS. 3 and 8, where the contacts are separated.

The connecting rod has a concave engagement area 12 for engaging at the projection 11 of the hand switching lever 7. It is preferable that the projection 11 have a recess, in order to avoid premature displacement of the connecting rod 10.

The contact separation occurs in a representative switching device 1, in which the latching is released. The latching location 24 is shown only in FIG. 9. As the switching lever 7 is moved back into the switched-off position, the latch 20 is shifted again under the latch support 22, creating a new latching, which is necessary to keep the contacts 4, 6 connected.

It is thus preferable that the housing 14 of the switching device 1 have a housing projection 15 in the area of the latch support 22, and that the connecting rod 10—particularly in the area of its placement on the latch support 22—have a striking pad 16 for propping up the latch support 22 on the housing projection 15 after the release of the latching. Thus, the projection 11 cannot push the connecting rod 10—and, with it, the latch support 22—too far from the latch 20. It can, therefore, be ensured that, when the switching lever 7 is moved back into the switched-off position, the latch 20 again forms a latching with the latch support 22.

It has proved advantageous that the affected housing projection 15 borders a trigger housing opening 17 for connecting the switch lock 2 with an external bigger. Switching devices 1 often have openings in the side walls of the housing 14 in order to functionally connect several such switching devices 1. The production costs can be reduced by supporting the connecting rod 10 on a housing projection 15, which serves an auxiliary function. FIG. 5 shows a sectional view of the upper housing half 27 with the housing projection 15. Likewise, FIG. 4 shows a partial sectional view of the upper housing half. FIG. 5 also presents a part of the upper housing half 27 with a view in its interior, which is why individual parts are arranged in a way that mirrors that of FIG. 4.

It should be noted that, in the context of the so-called trip-free mechanism, the present switching device 1 can be triggered even if the switching lever 7 is set into the position that corresponds with the switched-on state, with the resulting separation of the contacts 4, 6. The jump switch-off mechanism presented and described here concerns the manually triggered separation of the initially closed contacts 4, 6 by means of actuating the switching lever 7. Despite the term "manual," the actuation can take place via an external mechanical actuator, which moves the hand switching lever 7.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. A switching device, comprising:

a movable contact, positioned on a contact arm, movably attached to the switching device, the movable contact being configured to contact a housing-mounted contact and configured to establish a conductive current path through the switching device;

a switch lock, connected with the contact arm, the switch lock including a latch and a latch support, the latch support including a latching location configured to latch the latch to the latch support;

a hand switching lever, configured to contact the movable contact with the housing-mounted contact, the hand switching lever being connected with the contact arm;

a connecting rod, mounted movably on the latch support, the connecting rod bearing against a projection of the hand switching lever when the hand switching lever is in a position in which the movable contact and the housing-mounted contact are in contact, wherein an actuation of the hand switching lever, for separating the movable contact from the housing-mounted contact, moves the connecting rod and, thus, releases a latching of the latch support to the latch.

2. The switching device of claim 1, further comprising:

a first brace, mounted on the projection of the hand switching lever.

3. The switching device of claim 1, wherein the connecting rod includes a concave engagement area configured to engage at the projection of the hand switching level.

4. The switching device of claim 1, wherein the connecting rod is mounted on the latch support and can be rotated in this position.

5. The switching device of claim 1, further comprising:

a connecting rod spring, mounted on the latch support, the connecting rod spring impinging upon the connecting rod in a direction toward the switching lever.

6. The switching device of claim 1, further comprising:

a housing including a housing projection in an area of the latch support, wherein the connecting rod includes a striking pad configured to prop up the latch support on the housing projection.

7. The switching device of claim 6, wherein the housing projection borders a trigger housing opening configured to connect the switch lock with an external trigger.

8. The switching device of claim 2, wherein the switching lever is connected to the contact arm via the first brace and a bracket affixed to the first brace, and wherein the first brace is guided via a guiding slot of the latch.

9. The switching device of claim 1, configured as a safety switching device including the housing-mounted contact and the movable contact.

10. The switching device of claim 6, wherein the striking pad is disposed in a placement area of the connecting rod on the latch support.

11. The switching device of claim 1, wherein the latch is pivotably mounted.

12. The switching device of claim 8, wherein the latch is pivotably mounted.

* * * * *